US012575645B2

(12) United States Patent
Yang

(10) Patent No.: US 12,575,645 B2
(45) Date of Patent: Mar. 17, 2026

(54) INTELLIGENT DIGITAL SHOELACE END WRAPPING MACHINE

(71) Applicant: Fu-Hsiang Yang, Yuanlin (TW)

(72) Inventor: Fu-Hsiang Yang, Yuanlin (TW)

( * ) Notice: Subject to any disclaimer, the term of this patent is extended or adjusted under 35 U.S.C. 154(b) by 160 days.

(21) Appl. No.: 18/672,488

(22) Filed: May 23, 2024

(65) Prior Publication Data

US 2025/0234962 A1 Jul. 24, 2025

(30) Foreign Application Priority Data

Jan. 24, 2024 (TW) ..... 113102800

(51) Int. Cl.
*A43C 9/04* (2006.01)

(52) U.S. Cl.
CPC ..... *A43C 9/04* (2013.01)

(58) Field of Classification Search
CPC . A43C 9/04; A43D 98/00; A43D 8/02; A43D 117/00; A43D 119/00; A43D 2200/10; B65C 3/02; G09F 3/0295
See application file for complete search history.

(56) References Cited

U.S. PATENT DOCUMENTS 11,548,053 B1 * 1/2023 Maga ..... B21D 39/048

* cited by examiner

*Primary Examiner* — George R Koch
*Assistant Examiner* — Christopher C Caillouet
(74) *Attorney, Agent, or Firm* — MUNCY, GEISSLER, OLDS & LOWE, P.C.

(57) ABSTRACT

An intelligent digital shoelace end wrapping machine for processing a strap and a plastic roll into a plurality of shoelaces includes a material supply unit including a material feeding roller assembly for conveying the strap and having a strap guiding pulley for the strap to pass therethrough and then naturally falls down, a plastic roll feeding assembly for conveying the plastic roll, and a material supply drive assembly for driving the material feeding roller assembly and the plastic roll feeding assembly. A shoelace end wrapping unit is operable to soften and tighten a portion of the plastic roll around a portion of the strap, and then to cut the tightened portion of the strap to thereby form a shoelace. A control unit is signally connected to the material supply drive assembly and the shoelace end wrapping unit.

13 Claims, 7 Drawing Sheets

INTELLIGENT DIGITAL SHOELACE END WRAPPING MACHINE

CROSS-REFERENCE TO RELATED APPLICATION

This application claims priority to Taiwanese Invention patent application No. 113102800, filed on Jan. 24, 2024, and incorporated by reference herein in its entirety.

FIELD

This disclosure relates to a shoemaking machine, and more particularly to an intelligent digital shoelace end wrapping machine.

BACKGROUND

Referring to FIG. 1, an existing shoelace end wrapping machine includes a first holding member 11 and a second holding member 12 that are spacedly disposed and that are rotatable about an axis, and a hook member 13 for hooking and pulling a strap 14. During operation, when the first and second holding members 11, 12 continuously rotate, the hook member 13 repeatedly moves between first and second holding members 11, 12 to continuously feed and hook the strap 14 between the first and second holding members 11, 12, thereby forming a plurality of tension strap segments 141. Through this, the strap 14 is held tight to facilitate a cutting head device (not shown) located between the first and second holding members 11, 12 to cut each tension strap segment 141 and form a shoelace.

However, the existing shoelace end wrapping machine not only is heavy and occupies a large area of space, but also is difficult to adjust and repair. Moreover, since the strap 14 is woven from fibers, great tension will be generated during a tightening process, resulting in a large length error of the shoelaces after cutting, which is difficult to control yield. Thus, there is still room for improvement in terms of improving yield.

SUMMARY

Therefore, an object of the present disclosure is to provide an intelligent digital shoelace end wrapping machine that can alleviate at least one of the drawbacks of the prior art.

According to this disclosure, the intelligent digital shoelace end wrapping machine is configured for processing a strap and a plastic roll into a plurality of shoelaces. Each shoelace includes a strap body taken from the strap, and two aglets respectively disposed on two opposite ends of the strap body and made from a portion of the plastic roll. The shoelace end wrapping machine comprises a platform unit, a material supply unit, a shoelace end wrapping unit, and a control unit.

The material supply unit includes a material feeding roller assembly disposed on the platform unit for conveying the strap along a material guiding path, a plastic roll feeding assembly disposed on the platform unit for conveying the plastic roll, and a material supply drive assembly for driving the material feeding roller assembly and the plastic roll feeding assembly. The material feeding roller assembly includes a first strap guiding pulley for the strap to pass therethrough and then naturally falls down.

The shoelace end wrapping unit is disposed on the platform unit, and is operable to soften and tighten a portion of the plastic roll conveyed by the plastic roll feeding assembly around a portion of the strap conveyed by the material feeding roller assembly, and then to cut the tightened portion of the strap to thereby form a shoelace. The control unit is signally connected to and controls the material supply drive assembly and the shoelace end wrapping unit.

BRIEF DESCRIPTION OF THE DRAWINGS

Other features and advantages of the disclosure will become apparent in the following detailed description of the embodiment with reference to the accompanying drawings. It is noted that various features may not be drawn to scale.

DETAILED DESCRIPTION

Figure 1:
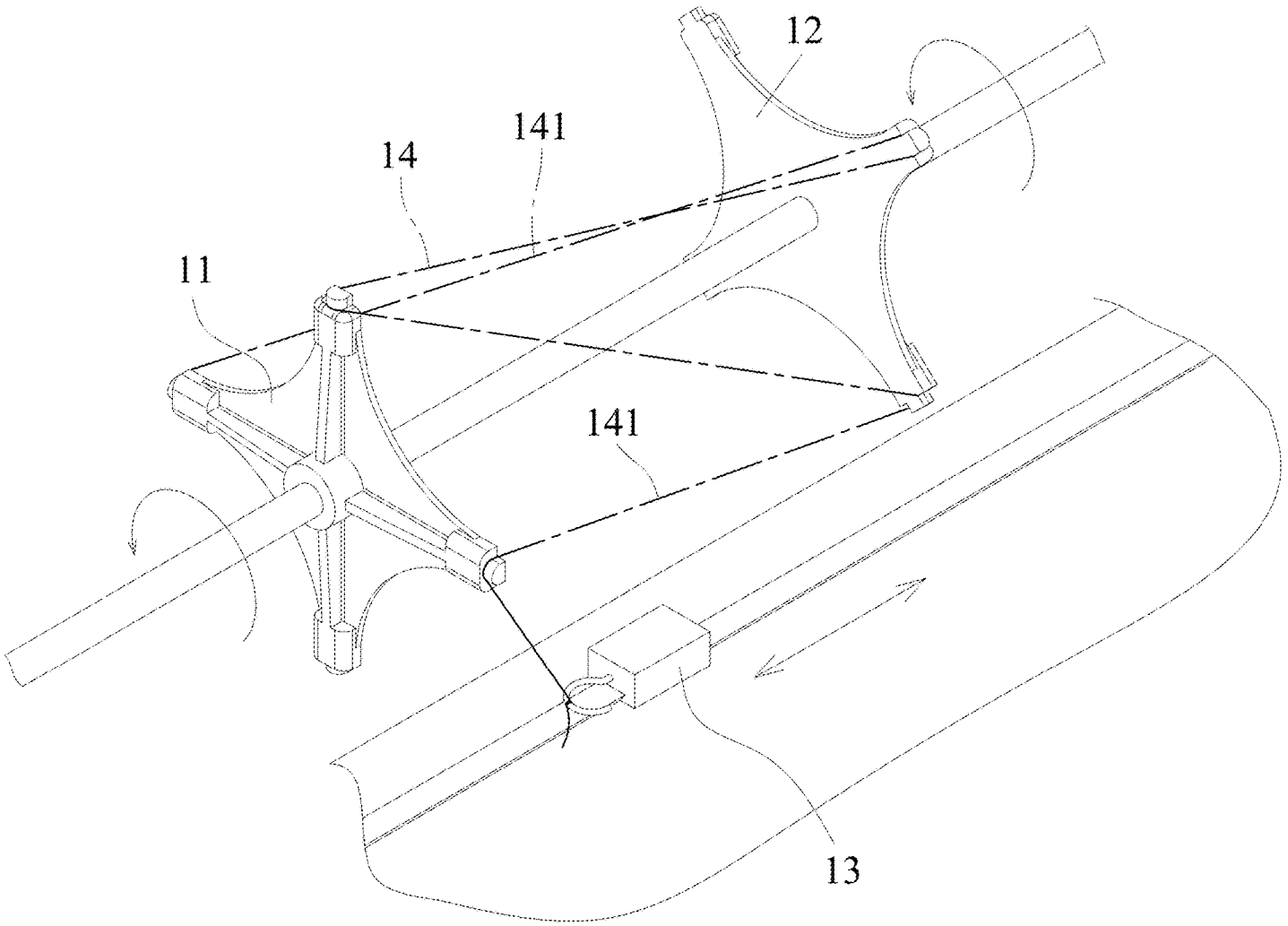
FIG. 1 PRIOR ART
FIG. 1 is a fragmentary perspective view of an existing shoelace end wrapping machine.

Referring to FIGS. 2 to 5, an intelligent digital shoelace end wrapping machine according to an embodiment of the present disclosure is configured for processing a strap 81 and a plastic roll 82 into a plurality of shoelaces 83 (only one shoelace 83 is shown in the drawings). The strap 81 may be of any suitable material, such as woven cotton or synthetic fabric. The plastic roll 82 has a plurality of patterns 821. Each shoelace 83 includes a strap body 831 taken from the strap 81, and two aglets 832 respectively disposed on two opposite ends of the strap body 831 and made from the plastic roll 82. The shoelace end wrapping machine includes a platform unit 2, a material supply unit 3, a shoelace end wrapping unit 4, a straightening unit 5, a control unit 6, and a receiving unit 7.

The platform unit 2 includes a base seat 21, and a die cutting holder 22 disposed on a top surface of the base seat 21. The die cutting holder 22 has a processing opening 221 extending along a top-bottom direction (Z) for passage of the strap 81 therethrough.

The material supply unit 3 includes a material feeding roller assembly 31 disposed on the platform unit 2 for conveying the strap 81 along a material guiding path (not shown), a plastic roll feeding assembly 32 disposed on the platform unit 2 for conveying the plastic roll 82, a material supply drive assembly 33 for driving the material feeding roller assembly 31 and the plastic roll feeding assembly 32, a sensing assembly 34, and an adjustment drive assembly 35 disposed on the platform unit 2.

Figure 2:
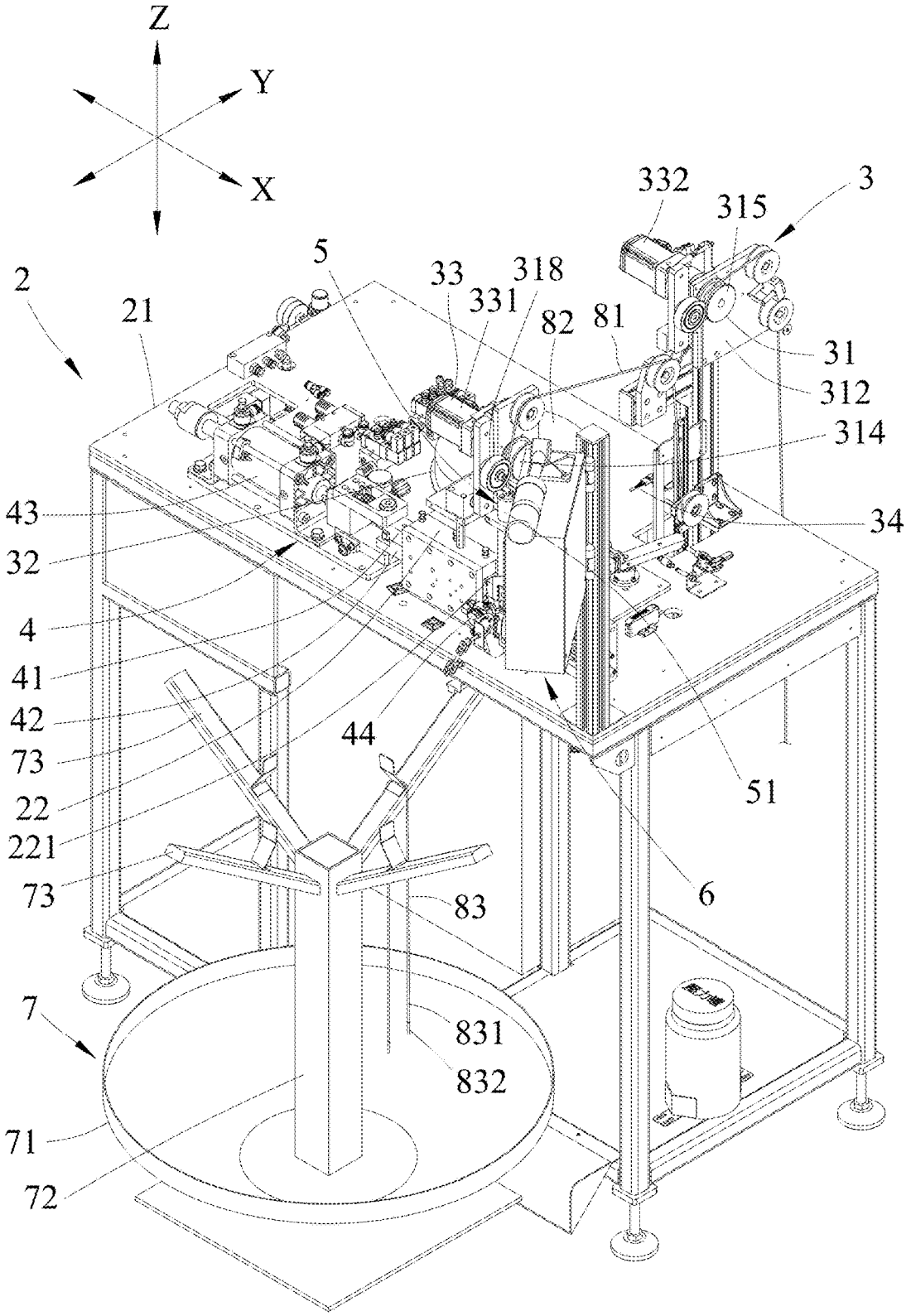
FIG. 2 is a perspective view of an intelligent digital shoelace end wrapping machine according to an embodiment of the present disclosure.
Figure 3:
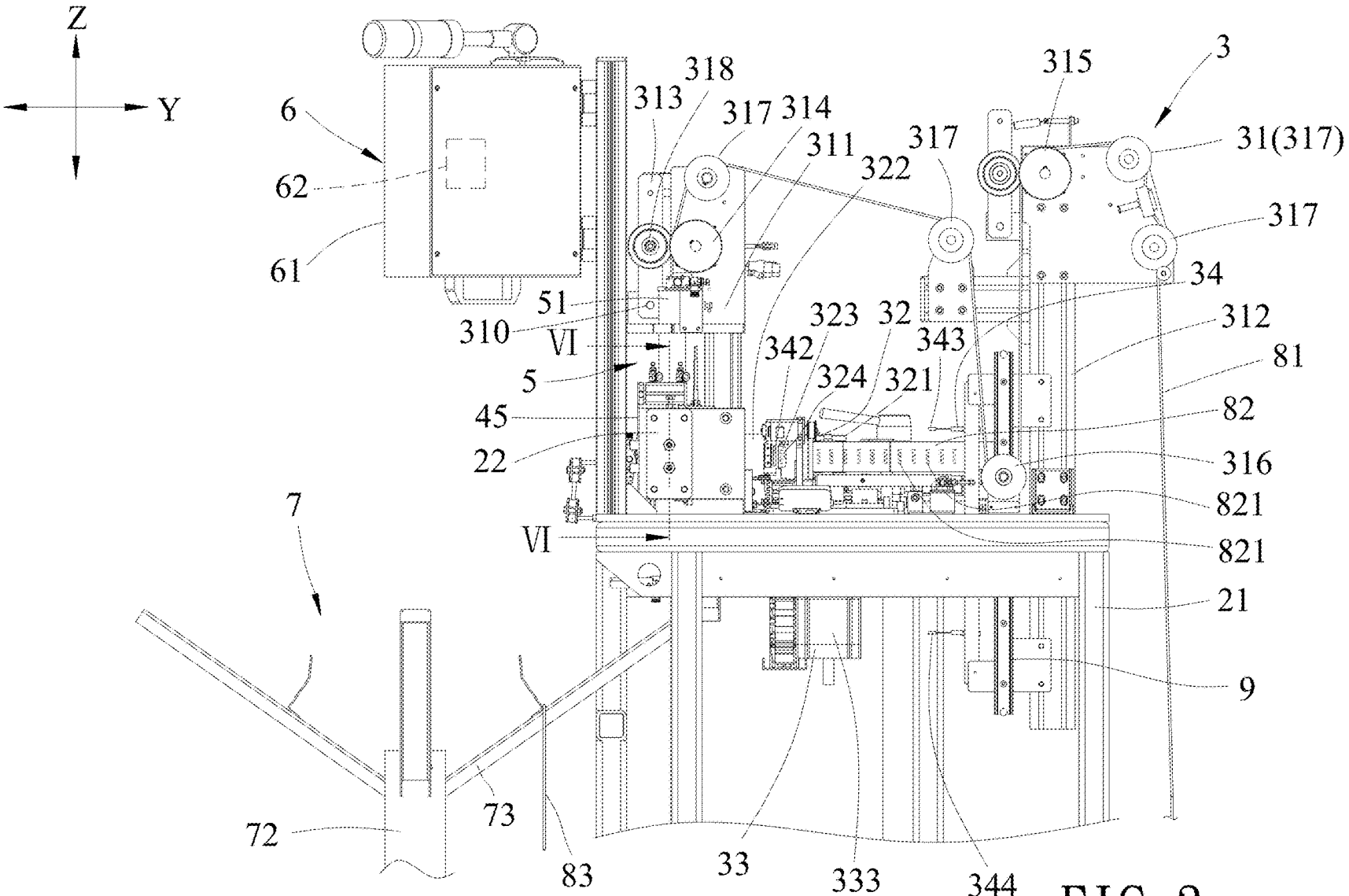
FIG. 3 is a fragmentary side view of the embodiment.
Figure 4:
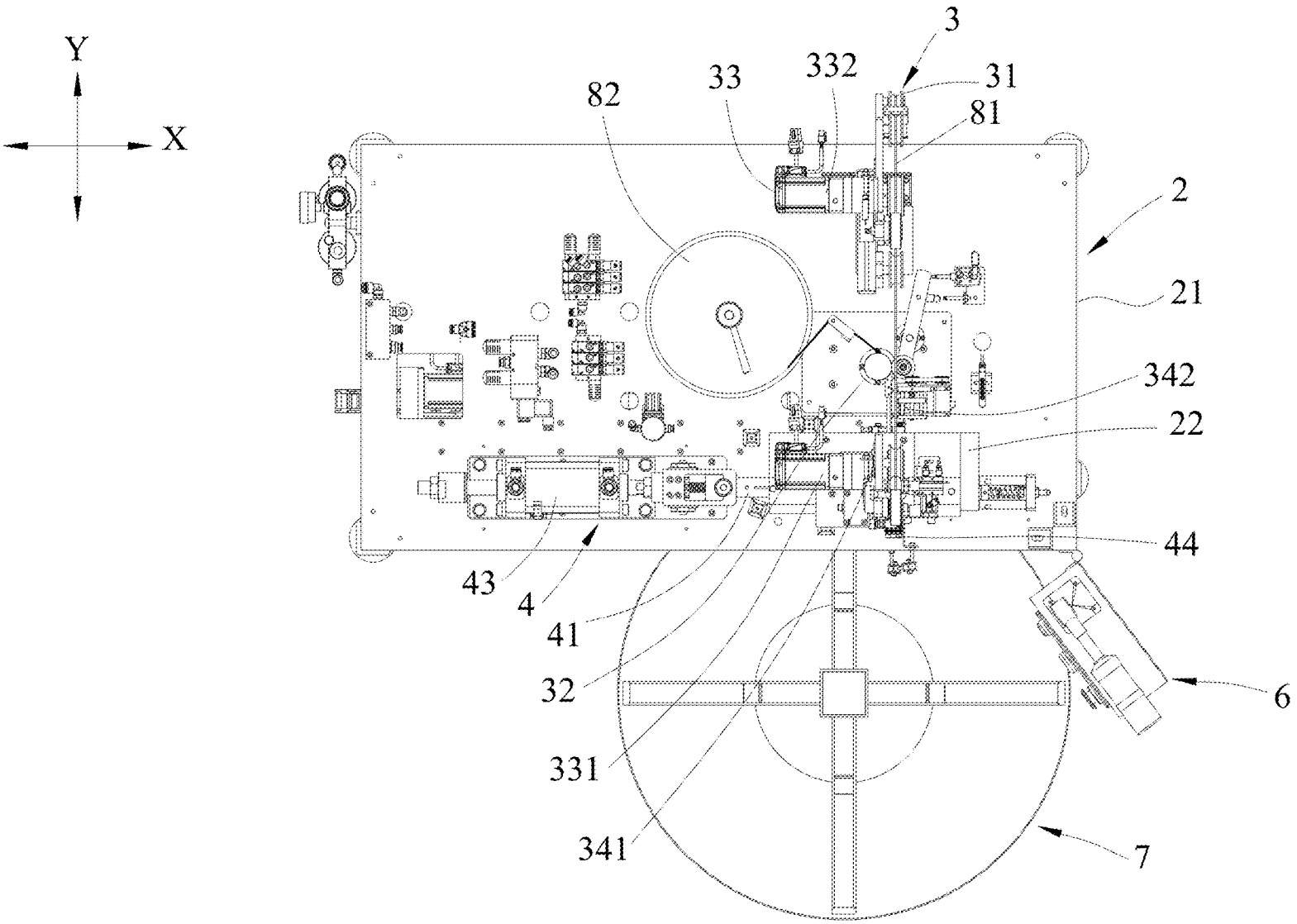
FIG. 4 is a top view of the embodiment.
Figure 5:
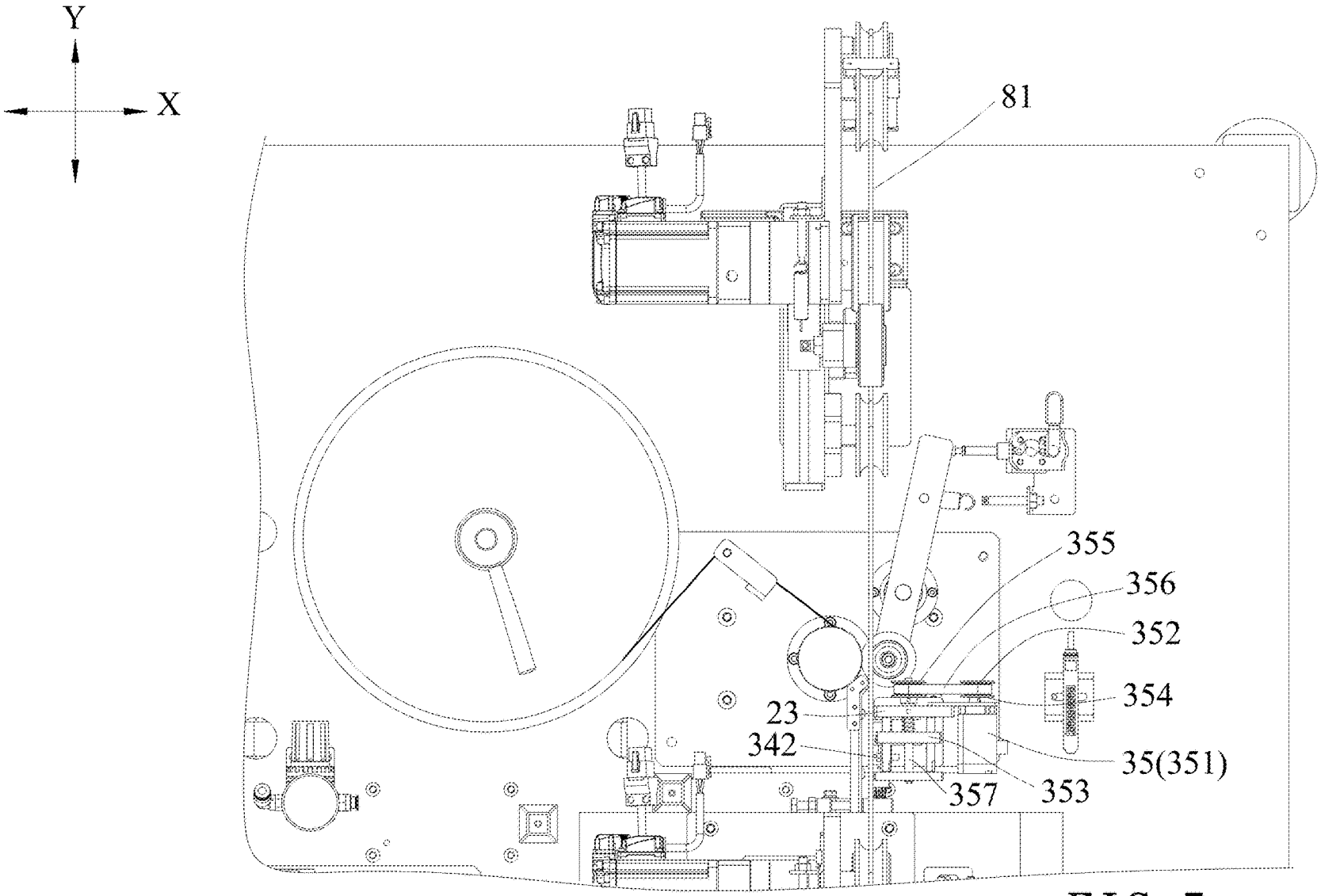
FIG. 5 is a fragmentary enlarged top view of the embodiment.
Figure 6:
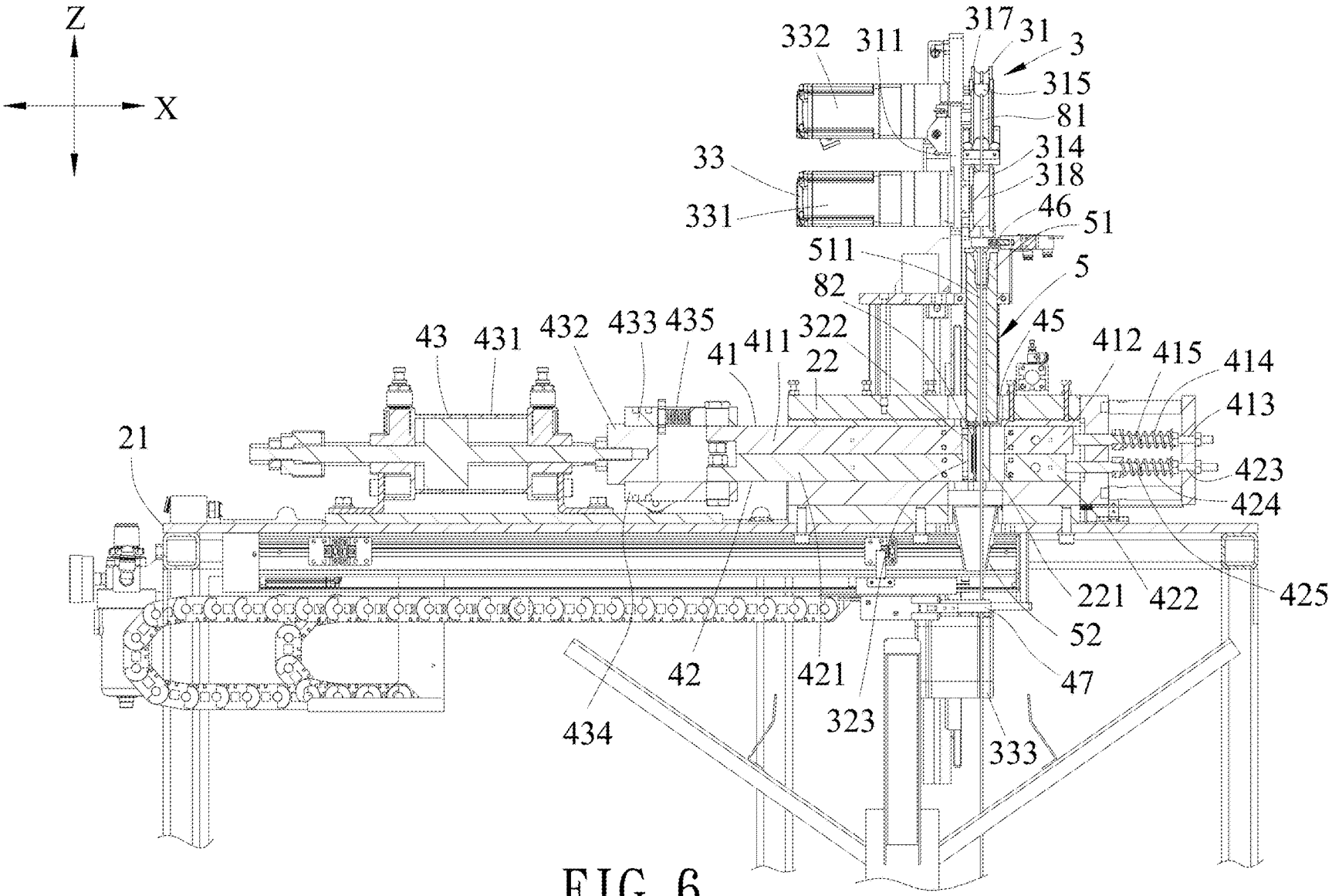
FIG. 6 is a sectional view of the embodiment taken along line VI-VI of FIG. 3.
Figure 7:
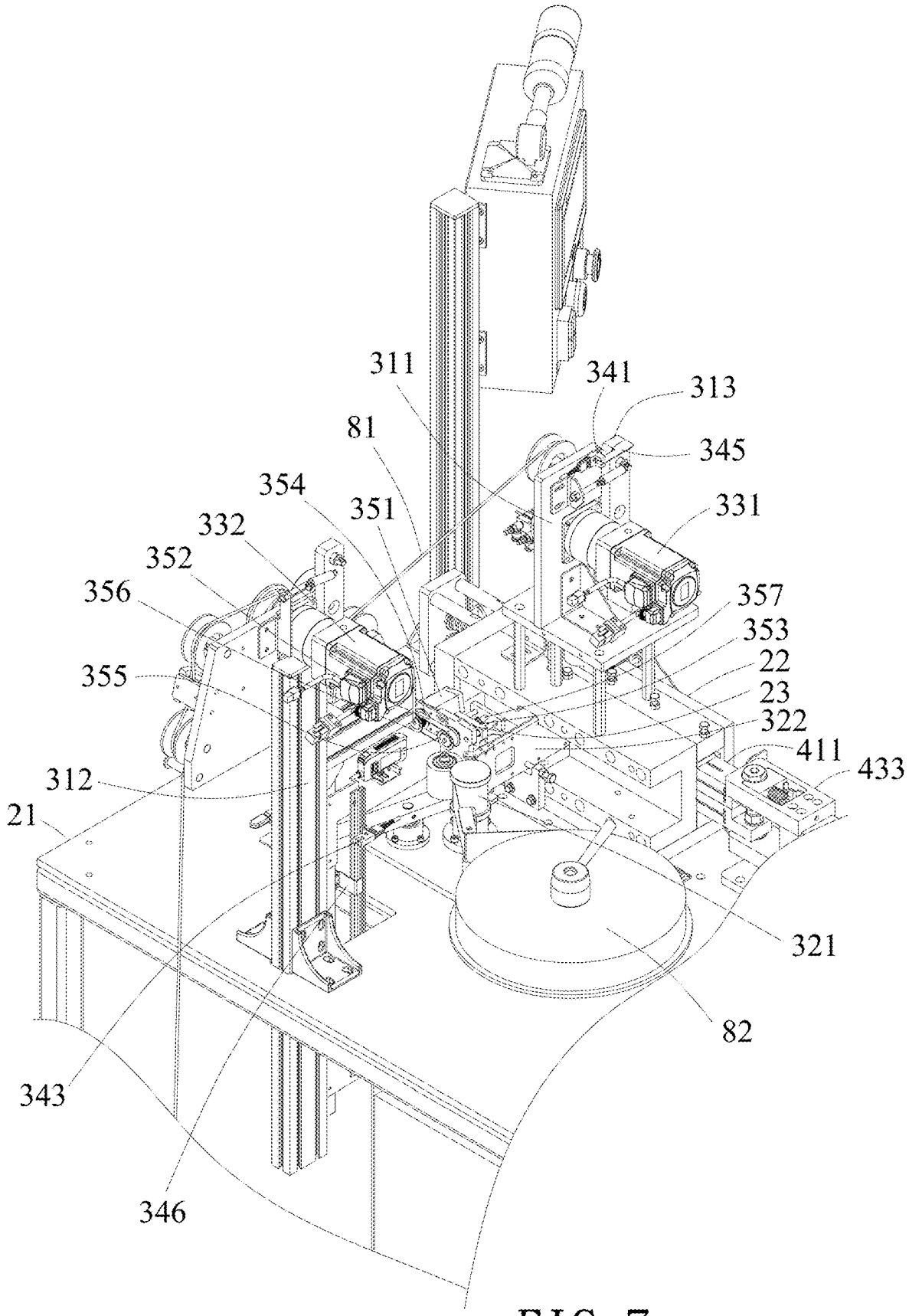
FIG. 7 is a fragmentary perspective view of the embodiment taken from another angle.

Referring to FIGS. 6 and 7, in combination with FIGS. 2 and 3, the material feeding roller assembly 31 includes a first support frame 311 disposed on the die cutting holder 22, a second support frame 312 spaced apart from the first support frame 311 along a front-rear direction (Y) and extending through the base seat 21 along the top-bottom direction (Z), a pivotable frame 313 pivotable relative to the first support frame 311 about a pivot point 310, a first strap guiding pulley 314 rotatably mounted to the first support frame 311, a second strap guiding pulley 315 rotatably mounted to the second support frame 312, a tension adjusting roller 316 rotatably disposed on the second support frame 312 and movable along the top-bottom direction (Z) through a guide rail 9 fixed to the second support frame 312, a plurality of steering rollers 317 rotatably disposed on the first and second support frames 311, 312 for steering the strap 81 to move along the material guiding path when the strap 81 is wound thereon, and a thickness sensing roller 318 rotatably disposed on the pivotable frame 313 and adjacent to the first strap guiding pulley 314. The thickness sensing roller 318 and the first strap guiding pulley 314 are located on two opposite sides of the strap 81 when the latter passes therebetween. The tension adjusting roller 316 is located between the first and second strap guiding pulleys 314, 315 along the material guiding path. When the pivotable frame 313 pivots relative to the first support frame 311, the thickness sensing roller 318 is driven by the pivotable frame 313 to move close to or away from the first strap guiding pulley 314.

With reference to FIG. 3, the strap 81 is fed from two of the steering rollers 317 that are adjacent to the second strap guiding pulley 315, and then winds through the second strap guiding pulley 315, the tension adjusting roller 316, a third one of the steering rollers 317 that is disposed above and distal to the tension adjusting roller 316, a fourth one of the steering rollers 317 that is spaced apart from the third steering roller 317 along the front-rear direction (Y), and between the first strap guiding pulley 314 and the thickness sensing roller 318. After the strap 81 passes through between the first strap guiding pulley 314 and the thickness sensing roller 318, it naturally falls down into the processing opening 221 (see FIG. 2). In this embodiment, the material guiding path is a path having multiple turns winding through the four steering rollers 317, the second strap guiding pulley 315, the tension adjusting roller 316, and between the first strap guiding pulley 314 and the thickness sensing roller 318.

With reference to FIGS. 3, 6 and 7, the plastic roll feeding assembly 32 includes a guide roller 321 drivable to rotate and configured for conveying the plastic roll 82, and a guide member 322 disposed on the base seat 21. The guide member 322 is a hollow plate that defines a plastic passage 323 extending along the front-rear direction (Y) and communicating with the processing opening 221, and that has a sensing window 324 opening in a left-right direction (X) and communicating with the plastic passage 323.

With reference to FIGS. 2, 3 and 6, the material supply drive assembly 33 includes a first motor 331 disposed on the first support frame 311 for driving the first strap guiding pulley 314, a second motor 332 disposed on the second support frame 312 for driving the second strap guiding pulley 315, and a third motor 333 disposed on the base seat 21 for driving the guide roller 321. In this embodiment, each of the first to third motors 331, 332, 333 is a step motor, but not limited thereto. In other embodiments, other equivalent components that can be precisely controlled may also be used.

Referring again to FIGS. 3 to 5 and 7, the sensing assembly 34 includes a thickness sensor 341 disposed on the first support frame 311, a pattern sensor 342 movably disposed on the platform unit 2 along the front-rear direction (Y), a tension upper sensor 343 disposed on the second support frame 312, a tension lower sensor 344 disposed on a lower end of the second support frame 312 and spaced apart from the tension upper sensor 343 along the top-bottom direction (Z), a thickness sensing plate 345 disposed on top of the pivotable frame 313, and an up-down sensing plate 346 connected to and movable along with the tension adjusting roller 316. Limited by the viewing angle, the tension adjusting roller 316 is not visible in FIG. 7.

With the thickness sensing plate 345 movable along with the pivotable frame 313 to move close to or away from the thickness sensor 341, a variation in a gap between the thickness sensing roller 318 and the first strap guiding pulley 314 can be detected and a signal can be sent by the thickness sensor 341. Through this, an abnormality, such as foreign matter or knot, present on the strap 81 can be detected and a warning signal or a shutdown signal can be sent.

The pattern sensor 342 is adjacent to the plastic roll 82 and corresponds in position to the sensing window 324. The pattern sensor 342 is configured to sense the patterns 821 through the sensing window 324 and then send a signal based on the result of sensing the patterns 821 to control discharging of the plastic roll 82.

When the strap 81 is affected by the difference in the rotational speed between the first and second motors 331, 332 and generates tension, the tension adjusting roller 316 will drive the up-down sensing plate 346 to move up or down therealong. Each of the tension upper and lower sensors 343, 344 is configured to sense whether the up-down sensing plate 346 is close to or away from a corresponding one of the tension upper and lower sensors 343, 344, and is used to further detect whether the tension adjusting roller 316 has reached an extreme position so as to send a signal to adjust the rotational speeds of the first and second motors 331, 332.

The adjustment drive assembly 35 includes an adjustment seat 23 mounted on the top surface of the base seat 21, an adjustment motor 351 disposed on the adjustment seat 23, a linkage module 352 connected to and driven by the adjustment motor 351, and a movable member 353 connected to the linkage module 352 and provided for the pattern sensor 342 to be disposed thereon. The adjustment motor 351 is configured to drive movement of the linkage module 352 and the movable member 353, which in turn drive the pattern sensor 342 to move along the front-rear direction (Y). The linkage module 352 of this embodiment includes a first belt pulley 354 and a second belt pulley 355 rotatably disposed on the adjustment seat 23 and spaced apart from each other along the left-right direction (X), a belt 356 wound around and coupled to the first and second belt pulleys 354, 355, and a threaded rod 357 fixedly connected to the second belt pulley 355 and threadedly connected to the movable member 353. In circumstances when the size of the pattern 821 is changed, the pattern sensor 342 can be driven by the adjustment drive assembly 35 to move along the front-rear direction (Y) so as to adjust the position of the pattern 821 when the plastic roll 82 is discharged, thereby assuring that the pattern 821 of different sizes can be located at an appropriate position and that the integrity of the pattern 821 in the portion of the plastic roll 82 that is expected to be cut can be maintained.

Referring once again to FIGS. 2, 3 and 6, the shoelace end wrapping unit 4 is connected to the die cutting holder 22, and includes a first die cutting assembly 41 and a second die cutting assembly 42 movably disposed on the die cutting holder 22 along the left-right direction (X), a die cutting drive assembly 43 disposed on the base seat 21 for driving the first and second die cutting assemblies 41, 42, a spray unit 44 disposed on the base seat 21 and adjacent to the processing opening 221 for spraying chemicals on the plastic roll 82, a pushing member 45 movably disposed on the die cutting holder 22 and adjacent to the processing opening 221, and an upper clamping jaw 46 and a lower clamping jaw 47 respectively located on two sides of the die cutting holder 22 that are opposite to each other along the top-bottom direction (Z). The lower clamping jaw 47 is movable along the left-right direction (X). The upper and lower clamping jaws 46, 47 are configured to clamp the strap 81. The pushing member 45 moves along the front-rear direction (Y) above the processing opening 221 to eliminate foreign matter. In this embodiment, the spray unit 44 is configured to spray acetone so as to soften the plastic roll 82.

The first and second die cutting assemblies 41, 42 are disposed immediately adjacent to each other along the top-bottom direction (Z). The first die cutting assembly 41 includes a first main cutting die 411 movably extending through an end of the die cutting holder 22 along the left-right direction (X), a first auxiliary cutting die 412 movably extending through the other end of the die cutting holder 22 along the left-right direction (X) and having an abutment portion 415, a first limiting member 413 disposed on the die cutting holder 22 and facing the abutment portion 415, and a resilient member 414 sleeved on the first limiting member 413 and the abutment portion 415. The second die cutting assembly 42 includes a second main cutting die 421 movably extending through the end of the die cutting holder 22 along the left-right direction (X), a second auxiliary cutting die 422 movably extending through the other end of the die cutting holder 22 along the left-right direction (X) and having an abutment portion 425, a second limiting member 423 disposed on the die cutting holder 22 and facing the abutment portion 425, and a resilient member 424 sleeved on the second limiting member 423 and the abutment portion 425.

The die cutting drive assembly 43 includes a driving member 431, an adapting member 432 connected to and driven by the driving member 431, a first connecting member 433 movably connected to the first main cutting die 411 and the adapting member 432, a second connecting member 434 connected between the adapting member 432 and the second main cutting die 421, and a biasing member 435 connected between the first connecting member 433 and the first main cutting die 411.

The straightening unit 5 includes an air guiding member 51 located below the first strap guiding pulley 314, and a strap guiding member 52 located below the processing opening 221. The air guiding member 51 defines an air guiding space 511 for passage of the strap 81 therethrough. The strap 81 is kept substantially vertical along the top-bottom direction (Z) by air flowing into the air guiding space 511 through an air hole of the straightening unit 5 which is connected to an air pump. The strap guiding member 52 defines a tapered hole for guiding the strap 81 to the lower clamping jaw 47.

The control unit 6 is signally connected to the material supply drive assembly 33, the sensing assembly 34, and the shoelace end wrapping unit 4, so that the entire operation of this disclosure can be automated and quantified, and abnormal conditions during the process can be detected. The control unit 6 includes an operation panel 61 operable to control the material supply drive assembly 33, the sensing assembly 34, and the shoelace end wrapping unit 4, and a storage module 62 for storing data.

The receiving unit 7 includes a holding plate 71, a post 72 extending upwardly from the holding plate 71 along the top-bottom direction (Z), and a plurality of angularly spaced-apart receiving rods 73 disposed on a top end of the post 72.

The shoelace end wrapping unit 4 is switchable between a standby state (see FIG. 6) and a processing state. In the standby state, the resilient members 414 and 424 respectively bias the abutment portions 415 and 425 to move away from the first and second limiting members 413, 423, respectively; the first main cutting die 411 is spaced apart from the first auxiliary cutting die 412; the biasing member 435 biases the first main cutting die 411 to move toward the processing opening 221 and the first auxiliary cutting die 412; the second main cutting die 421 is spaced apart from the second auxiliary cutting die 422; and the first and second die cutting assemblies 41, 42 are spaced apart from the strap 81. In the processing state, the first and second main cutting dies 411, 421 are moved along the left-right direction (X) to push against the first and second auxiliary cutting dies 412, 422, respectively, so that the first and second die cutting assemblies 41, 42 can clamp and cover a portion of the plastic roll 82 around a portion of the strap 81. Since the first connecting member 433 and the adapting member 432 are movable relative to each other, when the abutment portion 415 of the first auxiliary cutting die 412 abuts against the first limiting member 413, the first main cutting die 411 will stop moving, but the second main cutting die 421 will continue to advance a short distance. Thus, the first and second die cutting assemblies 41, 42 are misaligned along the left-right direction (X) to cut the covered portion of the strap 81 to thereby form a shoelace 83.

During operation, the material supply drive assembly 33 is actuated to drive the first and second strap guiding pulleys 314, 315 and the guide roller 321 to rotate so as to send the strap 81 and a portion of the plastic roll 82 to the processing opening 221. Then, the spray unit 44 is actuated to spray acetone to the portion of the plastic roll 82 so as to slightly dissolve and soften the same. With the upper and lower clamping jaws 46, 47 clamping a predetermined length of the strap 81, the first and second die cutting assemblies 41, 42 are then used to tighten the softened portion of the plastic roll 82 around the strap 81, after which the tightened portion of the strap 81 is cut to form a shoelace 83. It should be noted herein that the softened portion of the plastic roll 82 tightened around the strap 81 is formed into two aglets 832 of the shoelace 83 after the tightened portion of the strap 81 is cut. One of the aglets 832 is an upper end of the shoelace 83 cut at this time, and the other aglet 832 is a lower end of the shoelace 83 to be cut next. Finally, the lower clamping jaw 47 is actuated to move the shoelace 83 to one of the receiving rods 73 and then release it, so that the shoelace 83 is hung onto the one of the receiving rods 73 and is folded in half (see FIG. 2). Through this, processing of one of the shoelaces 83 can be completed.

Compared to the existing technology, this disclosure uses the material feeding roller assembly 31 to allow the strap 81 to hang naturally in a low tension state for performing the wrapping process thereof, so that the length error of the strap body 831 can be reduced, thereby achieving the effect of increasing the yield. Furthermore, through the multiple turns of the material guiding path, the overall size of the machine of this disclosure is reduced to achieve the effect of reducing the volume thereof, so that the machine of this disclosure does not occupy a large area of space. Moreover, through the control unit 6 and the sensing assembly 34, the entire operation can be automated and quantified, the process parameters can be easily adjusted, and the abnormal conditions during the process can be detected, thereby further achieving the effect of ease of use of this disclosure.

More specifically, through the control unit 6, a user can accurately control the rotational speeds of the first to third motors 331, 332, 333 to control the conveying speed of the strap 81 and the plastic roll 82. Moreover, the tension of the strap 81 can be controlled by controlling the rotational speed difference between the first and second motors 331, 332. Furthermore, the control unit 6 can coordinate with the sensing assembly 34 to detect abnormal conditions during the process, and based on the signal sent by the sensing assembly 34, the cooperating components can be controlled, such as timely adjusting the movement of the components or shutting down the machine when abnormal conditions are encountered, so that the action setting of the overall system can be more flexible. By virtue of the control unit 6 controlling the material supply drive assembly 33 and the shoelace end wrapping unit 4 to realize digitalization of this disclosure, compared with the inconvenience caused by the traditional technology which can only rely on the operator's feeling and experience for adjustment, the setting and abnormal conditions during the process can be recorded using the storage module 62, for example, parameters can be recorded separately for different types of shoes or different materials of shoelaces, so that they can be applied directly in the future without having to reset them every time, which is not only easy to use, but also suitable for customized shoelaces. In addition, through the digitization of the system parameters and various settings, the signals sent by the control unit 6 and the sensing assembly 34 are easy to read, which can then be utilized. For example, the signals can be sent to the control unit of other processes or the administrator's device to perform other processes, or for convenience of monitoring at any time. And if expansion of other assemblies is required, all digitized information can be directly used.

Therefore, the object of this disclosure can indeed be achieved.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. An intelligent digital shoelace end wrapping machine for processing a strap and a plastic roll into a plurality of shoelaces, each of the shoelaces including a strap body taken from the strap, and two aglets respectively disposed on two opposite ends of the strap body and made from a portion of the plastic roll, said shoelace end wrapping machine comprising:

a platform unit;

a material supply unit including a material feeding roller assembly disposed on said platform unit for conveying the strap along a material guiding path, a plastic roll feeding assembly disposed on said platform unit for conveying the plastic roll, and a material supply drive assembly for driving said material feeding roller assembly and said plastic roll feeding assembly, said material feeding roller assembly including a first strap guiding pulley for the strap to pass therethrough and then naturally falls down;

a shoelace end wrapping unit disposed on said platform unit and operable to soften and tighten a portion of the plastic roll conveyed by said plastic roll feeding assembly around a portion of the strap conveyed by said material feeding roller assembly, and then to cut the tightened portion of the strap to thereby form a shoelace; and a control unit signally connected to and controlling said material supply drive assembly and said shoelace end wrapping unit.

2. The intelligent digital shoelace end wrapping machine as claimed in claim 1, wherein said material feeding roller assembly further includes a first support frame disposed on said platform unit for said first strap guiding pulley to be rotatably mounted thereto, a second support frame disposed on said platform unit and spaced apart from said first support frame, and a second strap guiding pulley rotatably mounted to said second support frame and driven by said material supply drive assembly.

3. The intelligent digital shoelace end wrapping machine as claimed in claim 2, wherein said material feeding roller assembly further includes a pivotable frame pivotable relative to said first support frame, and a thickness sensing roller rotatably disposed on said pivotable frame and adjacent to said first strap guiding pulley, said thickness sensing roller and said first strap guiding pulley being configured to be located on two opposite sides of the strap when the strap passes between said thickness sensing roller and said first strap guiding pulley, said material supply unit further including a sensing assembly signally connected to said control unit, said sensing assembly including a thickness sensor disposed on said first support frame and configured to detect a variation in a gap between said thickness sensing roller and said first strap guiding pulley and then send a signal.

4. The intelligent digital shoelace end wrapping machine as claimed in claim 2, wherein said material feeding roller assembly further includes a tension adjusting roller rotatably disposed on said platform unit and movable along a top-bottom direction, said tension adjusting roller being located between said first strap guiding pulley and said second strap guiding pulley along said material guiding path.

5. The intelligent digital shoelace end wrapping machine as claimed in claim 1, wherein said platform unit includes a base seat, and a die cutting holder disposed on a top surface of said base seat and having a processing opening extending along a top-bottom direction for passage of the strap therethrough.

6. The intelligent digital shoelace end wrapping machine waiting machine as claimed in claim 5, wherein said shoelace end wrapping unit includes a first die cutting assembly and a second die cutting assembly that are movably disposed on said die cutting holder along a left-right direction and that are disposed immediately adjacent to each other along said top-bottom direction, said shoelace end wrapping unit being switchable between a standby state, in which said first die cutting assembly and said second die cutting assembly are configured to be spaced apart from the strap, and a processing state, in which said first die cutting assembly and said second die cutting assembly are configured to clamp and cover the portion of the plastic roll around the portion of the strap, and are misaligned in said left-right direction to cut the covered portion of the strap to thereby form the shoelace.

7. The intelligent digital shoelace end wrapping machine as claimed in claim 6, wherein said shoelace end wrapping unit further includes a die cutting drive assembly disposed on said base seat for driving said first die cutting assembly and said second die cutting assembly, said die cutting drive assembly including a driving member, an adapting member connected to and driven by said driving member, a first connecting member movably connected to said adapting member, a second connecting member connected between said adapting member and said second die cutting assembly, and a biasing member, said first die cutting assembly including a first main cutting die movably connected to said first connecting member, said biasing member being connected between said first connecting member and said first main cutting die for biasing said first main cutting die to move toward said processing opening in the standby state.

8. The intelligent digital shoelace end wrapping machine as claimed in claim 6, wherein said shoelace end wrapping unit further includes an upper clamping jaw and a lower clamping jaw respectively located on two sides of said die cutting holder that are opposite to each other along said top-bottom direction, said lower clamping jaw being movable along said left-right direction, said upper clamping jaw and said lower clamping jaw being configured to clamp the strap.

9. The intelligent digital shoelace end wrapping machine as claimed in claim 1, wherein the plastic roll has a plurality of patterns, said material supply unit further including a pattern sensor movably disposed on said platform unit along a front-rear direction, said pattern sensor being configured to be adjacent to the plastic roll, and being configured to sense the patterns and then to send a signal based on the result of sensing the patterns.

10. The intelligent digital shoelace end wrapping machine as claimed in claim 9, wherein said material supply unit further includes an adjustment drive assembly disposed on said platform unit, said adjustment drive assembly including an adjustment motor disposed on said platform unit, a linkage module connected to and driven by said adjustment motor, and a movable member connected to said linkage module and provided for said pattern sensor to be disposed thereon, said adjustment motor being configured to drive movement of said linkage module and said movable member, which in turn drive said pattern sensor to move along said front-rear direction.

11. The intelligent digital shoelace end wrapping machine as claimed in claim 10, wherein said linkage module includes a first belt pulley and a second belt pulley rotatably disposed on said platform unit and spaced apart from each other along a left-right direction, a belt wound around and coupled to said first belt pulley and said second belt pulley, and a threaded rod fixedly connected to said second belt pulley and threadedly connected to said movable member.

12. The intelligent digital shoelace end wrapping machine as claimed in claim 1, further comprising a straightening unit that is disposed on said platform unit and that includes an air guiding member located below said first strap guiding pulley, said air guiding member being configured for passage of the strap therethrough and for keeping the strap substantially vertical by air flowing in said air guiding member.

13. The intelligent digital shoelace end wrapping machine as claimed in claim 1, wherein said control unit includes a storage module for storing data.

* * * * *